United States Patent [19]

Pontoppidan

[11] Patent Number: 4,581,778

[45] Date of Patent: Apr. 15, 1986

[54] MECHANISM FOR RAISING AND LOWERING A SEAT ESPECIALLY DESIGNED FOR HANDICAPPED PERSONS

[75] Inventor: Eskild Pontoppidan, Lyngby, Denmark

[73] Assignee: Flemming Hvidt Mobelarkitektfrima A/S, Copenhagen, Denmark

[21] Appl. No.: 767,080

[22] Filed: Aug. 20, 1985

Related U.S. Application Data

[63] Continuation of Ser. No. 552,967, Nov. 17, 1983, abandoned, which is a continuation of Ser. No. 341,790, Jan. 22, 1982, abandoned.

[30] Foreign Application Priority Data

Jan. 23, 1981 [DK] Denmark ..... 330/81

[51] Int. Cl.[4] ..... A47K 13/10; A47C 1/00

[52] U.S. Cl. ..... 4/251; 297/DIG. 10

[58] Field of Search ..... 4/240, 236, 237, 251, 4/480, 483, DIG. 8; 297/338, 345, DIG. 10

[56] References Cited

U.S. PATENT DOCUMENTS 1,025,915 5/1912 Hoff ..... 297/338

3,479,086 11/1969 Sheridan ..... 297/DIG. 10

4,185,335 1/1980 Alvis ..... 4/251

FOREIGN PATENT DOCUMENTS 553561 9/1974 Switzerland .

*Primary Examiner*—Charles E. Phillips

*Attorney, Agent, or Firm*—Fleit, Jacobson, Cohn & Price

[57] ABSTRACT

A mechanism for raising and lowering a seat, especially designed for handicapped persons, comprises two supporting arms (A', B') which are both at one of their ends coupled to the seat (E), at the front and rear edge thereof, respectively. At their other end, the supporting arms (A', B') cooperate with a fixed point (1', 2') each. At least one of the supporting arms is coupled to a driving member and the two supporting arms (A', B') are interconnected at a point between their ends. With a view to obtaining a space-saving but all the same stable mechanism allowing a physiologically correct trajectory of the seat during its raising and lowering, the supporting arms (A', B') are directly pivotally interconnected (D), and one of the supporting arms cooperates with the fixed point in such a manner that it is displaceable in relation to said point.

6 Claims, 10 Drawing Figures

Figure 1:
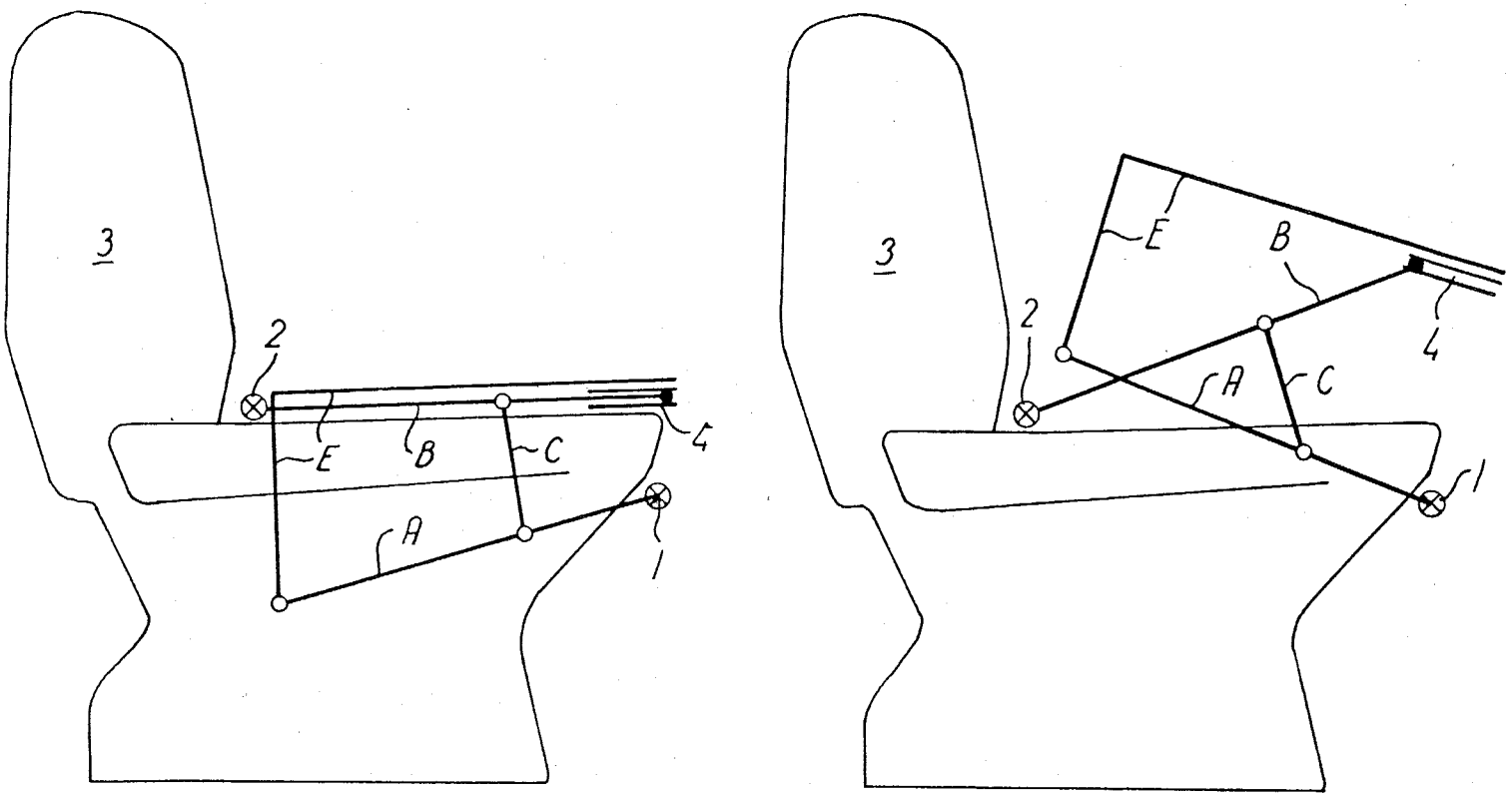
FIG. 1 PRIOR ART

MECHANISM FOR RAISING AND LOWERING A SEAT ESPECIALLY DESIGNED FOR HANDICAPPED PERSONS

This application is a continuation, of application Ser. No. 552,967, filed Nov. 17, 1983, which is a continuation of application Ser. No. 341,790, filed Jan. 22, 1982 both now abandoned.

The invention relates to a mechanism for raising and lowering a seat, in particular for handicapped persons, which mechanism comprises two supporting arms which are both at one of their ends coupled to the seat, at the front and rear edge thereof, respectively, and cooperate at their other end with a fixed point, one at least of the supporting arms being coupled to a driving member and the two supporting arms being interconnected at a point between their ends.

Seats provided with such mechanisms are used by physically handicapped persons who can only with difficulty, or maybe not at all, sit down or get up from a seat, e.g. a chair or a toilet seat. In the standing position, the disabled can lean against the seat in its raised position and activate the driving member which then moves the seat to a lowered position corresponding to a normal seated position for the user. When the user, from this position, activates the driving member in the opposite direction, the seat is moved back to its raised position where the user is practically standing and able to leave the seat.

It is important that both during the raising and the lowering movement the seat should follow a trajectory imposing the least possible load on the knee joints of the user, i.e. a trajectory whose centre is positioned before the front edge of the seat and coincides as far as possible with the user's knee joint. A pure tilting movement about the front edge of the seat is simple to achieve but unsatisfactory to the user.

U.S. patent specification No. 4,185,335 discloses a mechanism of the type dealt with above, which is explained in more detail in the following with reference to FIG. 1 and which to a great extent fulfills the conditions set forth above as regards the path of movement of the seat In the known mechanism, the raising and lowering movement of the seat is achieved in that both supporting arms coupled to the seat are pivotally attached to fixed points at their other ends, and in that the supporting arm which is connected with the driving member and thereby is made to pivot about its fixed hinge point is, at some distance from said point, coupled to the second supporting arm through a connecting bar pivotally coupled to both supporting arms between their extremities and establishing thereby an interconnection of these supporting arms. The motion of the supporting arm coupled to the driving member is thereby transferred to the second supporting arm through the connecting bar, and by suitable selection of the distances between the connecting points of the two supporting arms with the connecting bar and their respective fixed hinge points, one can achieve a raising movement of the seat from the lowered position, e.g. above a toilet bowl, which is not a pure tilting movement about the front edge of the seat but a movement starting as purely vertical and thereafter changing into an upward and onward movement, so that the load upon the user's knee joint will be minimal.

A drawback of the known mechanism is that this desired path of motion is achieved by interconnecting the two supporting arms by the special connecting bar, the stability of the whole mechanism being reduced as a result of the additional hinge joint thus inserted. In the connection between the engagement point of the driving member and one edge of the seat, two hinge joints are thus involved, viz. one between the supporting arm coupled to the driving member and the connecting bar, and one more between the connecting bar and the second supporting arm coupled to the seat at the said edge. The desired trajectory of the seat is thus achieved by inserting a further hinge joint which reduces the stability of the mechanism.

As a result of the special construction of the known mechanism with a further hinge joint between the driving member and one edge of the seat, said known mechanism does not appear to be suitable for withstanding appreciable loads outside the plane containing the hinge points. In the embodiment described in the above-mentioned U.S. patent specification No. 4,185,335 which is intended for use in connection with a toilet seat, provision is made of a raising and lowering mechanism on both sides of the toilet, and the two mechanisms are interconnected by a transverse frame which stabilizes the double mechanism thus provided. The load, originating mainly from the user's weight, is distributed on the two mechanisms and, moreover, the load thus halved is applied to each mechanism in, or substantially in the planes containing the hinge joints of the mechanisms without any appreciable eccentric load components.

The provision of two raising and lowering mechanisms for each seat makes the device more complicated and expensive and the further space requirements in connection therewith, which make pieces of furniture and other arrangements provided with seats of the type in question undesirably bulky, are particularly unsuitable for toilets where there will not always be space for a raising and lowering mechanism on both sides of a toilet bowl which is often mounted close to a wall and which also requires space for water pipes, waste pipes, etc.

The present invention has for its object to provide a simpler mechanism for raising and lowering a seat along the above-mentioned desired trajectory, which mechanism owing to a minimum number of hinge points between seat and driving member is so stable that a single mechanism can activate a seat, even if this mechanism is to be mounted on one side of the seat, as is necessary for instance in a toilet where a central placing is not possible.

To that effect, a mechanism of the kind mentioned initially is according to the invention characterized in that the supporting arms are directly pivotally interconnected and that one of the supporting arms cooperates with the fixed point in such a manner that it is displaceable in relation to said point.

As a result of the direct interconnection of the two supporting arms, the special connecting bar is omitted and there is only one hinge joint between the engagement point of the driving member and the points at which the supporting arms are coupled to the seat, viz. the hinge connection between the supporting arms. The additional hinge joint which in the known mechanism is inserted as a consequence of the provision of the connecting bar between the supporting arms is in the mechanism according to the invention actually removed from the driving part of the mechanism and transferred to the guiding part where it is practically unloaded and thus does not influence the stability of the mechanism. All hinge joints and connecting points of the known mechanism are under load and no part of said known mechanism can be regarded as an unloaded, purely guiding part as the one provided in the mechanism according to the invention. This results in a substantial stabilizing of the mechanism according to the invention as compared to the known mechanism, and experiments have shown that one mechanism on one side of a toilet is sufficient to ensure a fully satisfactory raising and lowering of a seat loaded with a person, e.g. a toilet seat. Thus, the mechanism according to the invention results in a substantial simplification and reduction in cost of manufacture, due to the fact that only a single mechanism is required to operate the seat, and also results in a substantial simplification of the mounting of the mechanism, which is of extreme importance in particular for toilet seats.

The invention will in the following be explained in more detail by way of example on basis of a few embodiments of a raising and lowering mechanism, reference being made to the drawing in which FIG. 1 is a schematic view showing the principle of a known raising and lowering mechanism.

Figure 2:
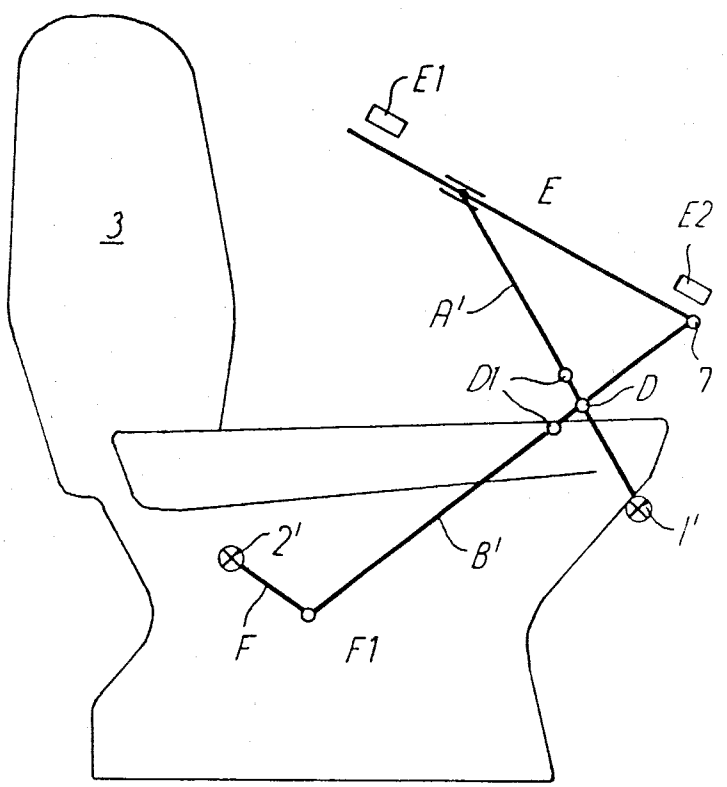
Figure 2:
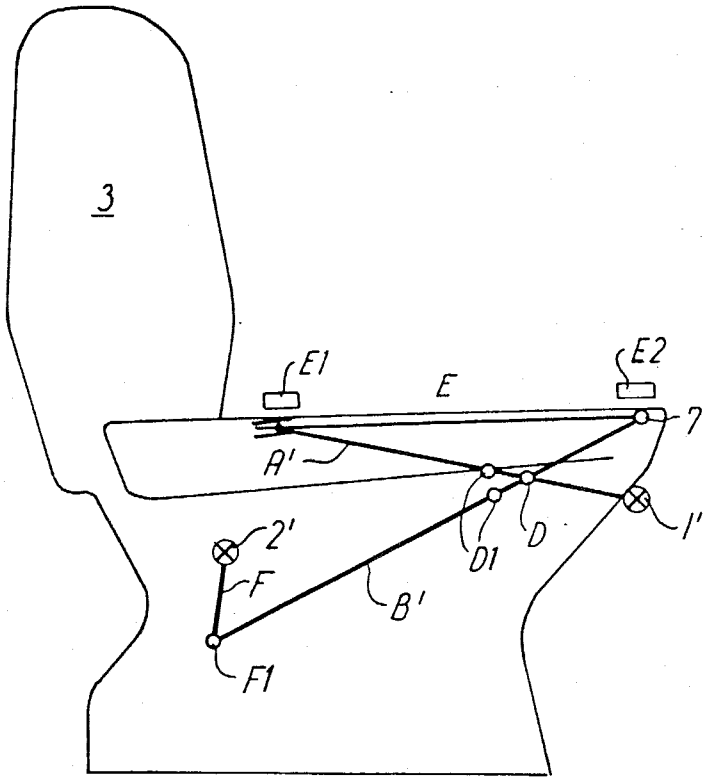
Figure 3:
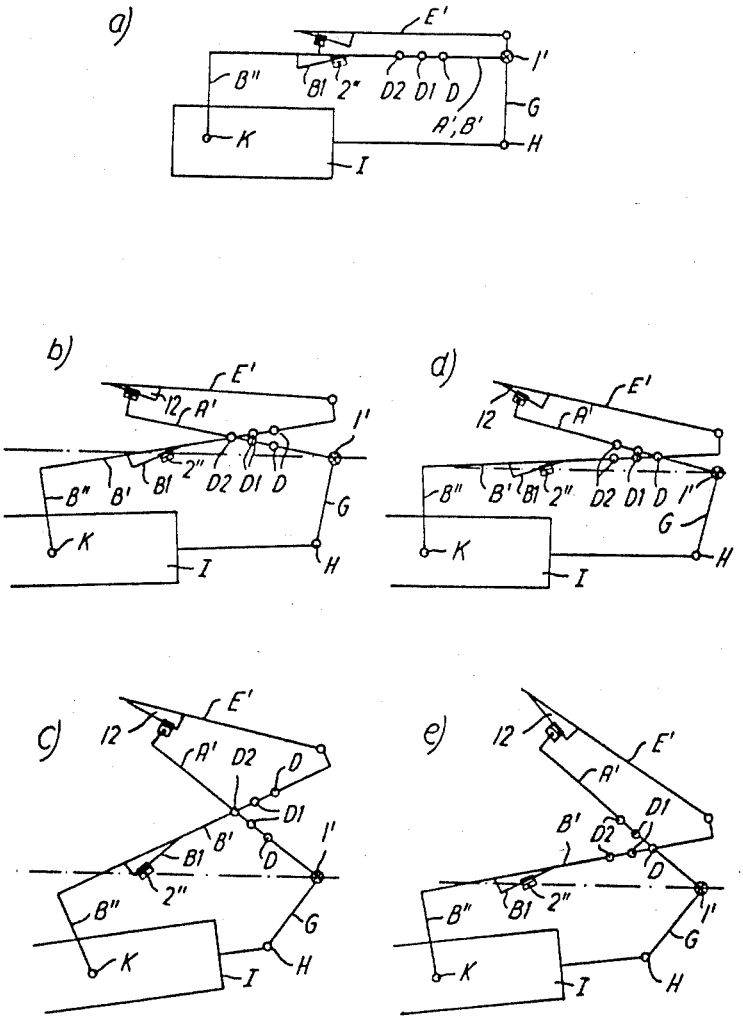
Figure 4:
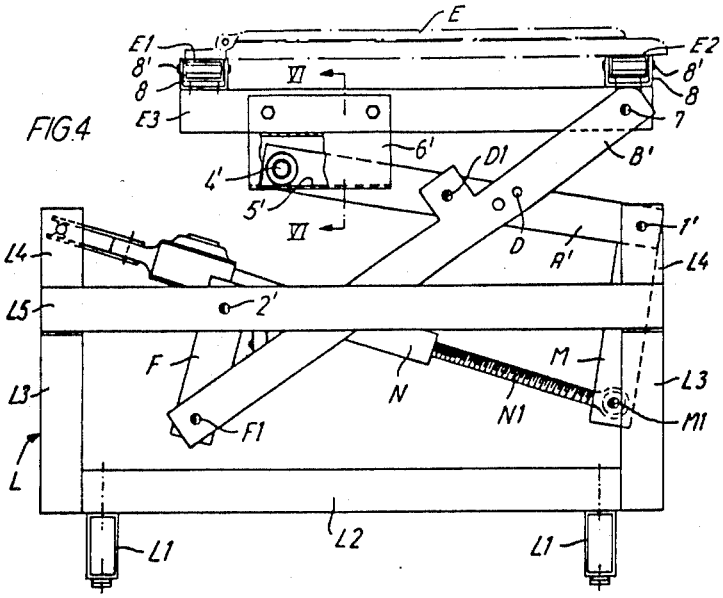
Figure 5:
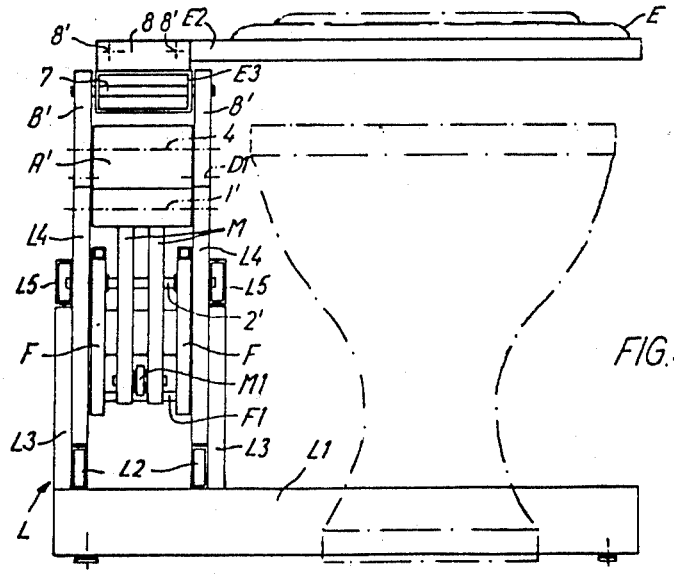
Figure 6:
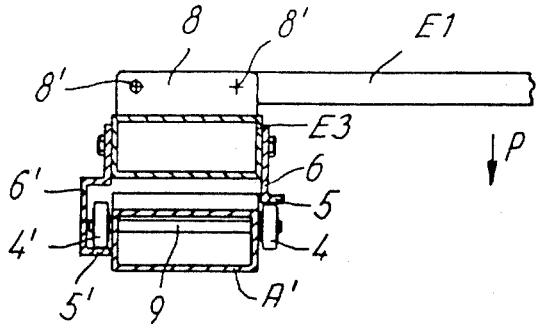
Figure 7:
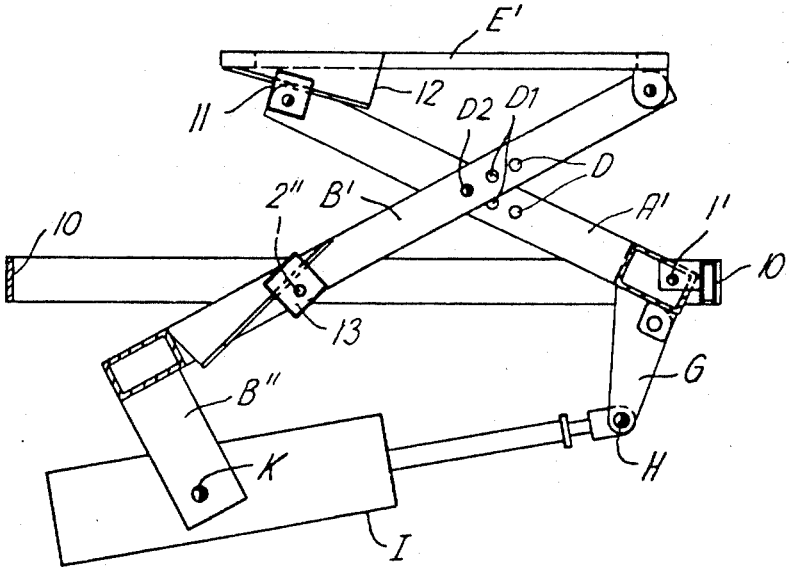

FIGS. 2 and 3 corresponding schematic views of two mechanisms according to the invention, FIG. (*3a*) shows a mechanism in accordance with the present invention with several possible pivot points D., $D_2$, and $D_2$, while FIGS. (*3b*) and (*3c*) show different positions of the mechanism when pivot point $D_2$ is used and FIGS. (*3d*) and (*3e*) show different positions of the mechanism when pivot point D is used, FIGS. 4–6 a practical embodiment of a mechanism according to the invention especially suitable for one-sided mounting, and FIG. 7 another embodiment of a mechanism according to the invention.

FIG. 1 is a schematic view of the essential movable parts of a raising and lowering mechanism for a seat, especially a toilet seat, as described in the above-mentioned U.S. patent specification No. 4,185,335. The mechanism is shown with the seat in the lowered position to the left of the figure and in the raised position to the right, and it is mounted on one side of a toilet bowl, a corresponding mechanism being provided on the opposite side. The two mechanisms are interconnected through a transverse frame, not shown in detail but comprising two transverse bars 1 and 2, each being pivotally coupled to an end of one of the two supporting arms A and B, respectively, and serving as fixed rotation points for the respective arms, said arms supporting at their other respective end a toilet seat which is only shown schematically at E. At its front side turning away from the cistern 3, the seat is mounted displaceably on the end of the bar B opposite the rotation point 2, as indicated by 4 in FIG. 1, and at its rear underside the seat E is pivotally mounted on the end of the arm A opposite the fixed rotation point 1, as also indicated in the figure.

A driving member, not shown, activates the arm A to pivot about the bar 1 which acts as a hinge for the arm A so that this can be moved between the positions shown at the left and the right of FIG. 1. The movement of the arm A is conveyed to the arm B through a connecting bar C, so that the resulting trajectory of the seat E is not a pure tilting movement about the front edge of the seat but, as a result of the motion transfer through the connecting bar C from the arm A to the arm B and of the sliding accommodation 4 of said arm B in the seat E, a movement which from the lowered position shown on the left of FIG. 1 begins as a practically pure vertical movement and then continues as an obliquely forward and upward movement, as will at first sight appear from the sketches showing inter alia that during the raising of the seat, the terminal part of the arm B connected with the seat E moves back in the track 4 provided in the seat wherein it is mounted and that the connecting bar C changes its angular position in relation to the arms A and B.

The trajectory of the toilet seat thus achieved and just mentioned before is very convenient for the user, his or her knee joints being thereby under the least possible load during the movement of the seat from the lowered to the raised position or vice versa, but this desirable trajectory of the seat is achieved by means of a special connecting element, viz. the connecting bar C between the arms A and B, and this connecting element involves further hinge joints in the driving connection between the driving member and the seat in addition to the hinge joints which would be necessary for a pure tilting movement of the seat, this latter movement being, on the other hand, less convenient for the user.

These hinge joints reduce the stability of the mechanism and this results in the known mechanism being hardly able to support substantial eccentric loads from a user whose centre of gravity will lie essentially in the middle of the toilet seat and will act in a plane parallel to, but displaced from the plane containing the hinge joints and the rotation points.

In order to consider the limited stability of the known mechanism, provision is made, as mentioned above, of a mechanism mounted on both sides of a toilet, said mechanisms being interconnected through a stabilizing transverse frame, but this two-sided mounting will in many cases be impossible to realize in practice, especially in connection with existing toilets, because there will generally be no space for a raising and lowering mechanism on both sides of the toilet, as toilets are often mounted close to a wall and space is required for water pipes, waste pipes and similar fittings.

A raising and lowering mechanism according to the invention, whose principle of operation is outlined in FIG. 2, difers in particular from the known mechanism described in the above and shown in FIG. 1 in that the special connecting bar C between the arms A and B in FIG. 1 is omitted and replaced by a direct coupling D between the supporting arms for the toilet seat which in FIG. 2 are designated A′ and B′, and in that the arm B′ in the embodiment of the mechanism according to the invention shown in FIG. 2 is coupled to its fixed rotation point 2′ in a crank-like manner through a connecting bar F. Furthermore, the driven arm A′ is slidingly coupled to the seat E, while the arm B′ is pivotally coupled to the seat. The driving member, not shown, thus activates also in FIG. 2 the supporting arm A′ to pivot about the fixed point 1′, e.g. by acting (pulling) on a possible bent extension of the arm A′ beyond the point 1′.

When, from the position shown on the left in FIG. 2, the arm A′ is activated to pivot or swing about the fixed point 1′, the coupling point D will be moved along an arc-shaped path in clockwise direction. The arm B′ being coupled to the fixed point 2′ through the bar F will, however, pivot counter-clockwise about the coupling point D in relation to the arm A′, and thereby a further vertical movement component will be imparted to the end of the arm B' coupled to the front edge of the seat E, so that the front edge of the seat follows a path diverging from the circular arc shape and the movement of the seat will then be physiologically more correct than a pure tilting movement.

As it appears, the mechanism outlined in FIG. 2 will move the seat E along a path similar to that provided by the known mechanism, but this desired trajectory is achieved by the mechanism according to the invention with fewer hinge joints in the driving part of the mechanism, i.e. the part provided between the driving member at point 1 and point 1', respectively, and the seat E.

Between the driving member, which may for instance be an electrically driven self-locking worm drive mechanism so that it also can act as a brake during the lowering of the seat, and the seat E - or a supporting frame or supporting arms E1, E2 for said seat - there is only one hinge point, viz. the pivotal coupling D between the supporting arms A' and B', in the mechanism according to the invention. The hinge point F1 composed of the pivotal coupling between the arm B' and the connecting bar F is, just as the pivotal coupling between the connecting bar F and the fixed point 2', disposed in what can be called a guiding and stabilizing part of the mechanism which is under very weak load or practically under no load at all. The loaded part of the mechanism according to the invention is thus subject to far less backlash than the known mechanism where both the hinge point between the supporting arm A and the connecting bar C and the hinge point between the connecting bar C and the supporting arm B are under full load.

This smaller backlash and the resulting greater stability of the mechanism according to the invention as compared to the known mechanism make it possible to achieve a fully satisfactory and wobble-free movement of the seat along the desired trajectory also when mounted on one side only of a seat, e.g. a toilet seat. The direct and purely pivotal coupling D between the arms A' and B' allows also a better distribution of the load originating from the seat between the arms A' and B' than the pivotal and swingable coupling C between the arms A and B of the known mechanism, and the stability of the mechanism according to the invention in relation to the known mechanism is thereby further increased and so is also its applicability for mounting on one side only of a seat.

FIG. 3 shows another embodiment of the mechanism according to the invention which is characterized by a very small height in the lowered position and therefore is particularly suitable for central mounting under a seat, e.g. in an ordinary armchair. Parts of FIG. 3 corresponding to those shown in FIG. 2 are provided with corresponding reference signs.

In the embodimet shown in FIG. 3, the supporting arms A' and B' are also coupled to the seat which is here an ordinary bottom of a chair, or to a frame E' carrying this seat, at the front and the rear edge of the seat and these arms are pivotally interconnected at a point located between their extremities. FIG. 3 shows three of such coupling points D, D1, D2 on each arm through which these arms can be interconnected so as to make it possible to vary the inclination of the seat in the raised position, cf. the two variation possibilities with minimum and maximum inclination of the seat as shown, respectively, on the left and the right of FIG. 3 at b and c and at d and e, respectively. The embodiment of FIG. 2 may, moreover, be adjustably carried out in a corresponding manner, as indicated by D1.

Also in FIG. 3, the arm A' is activated to pivot about the fixed point 1', a bar G coupled to the arm A' being coupled through a hinge joint H to a driving member such as a worm drive designated generally by I.

At its opposite end the arm A' is mounted in a sliding bearing provided in the frame E' supporting the seat, which bearing, as will appear from FIG. 3, has its sliding surfaces extending obliquely downward, forming an acute angle, e.g. 10°–15°, with the plane of the seat frame. The corresponding bearing or guide in FIG. 2 can be designed correspondingly with an inclination in relation to the plane of the seat.

The second supporting arm B' is, as in the embodiment shown in FIG. 2, coupled by one of its extremities to the supporting frame E' of the seat at the front edge of the seat, and at its other extremity the arm B' is led through a pivotal bearing 2'' and with a bent terminal part B'' it is pivotally coupled to a shaft K whereon the driving member I is pivotally suspended. Thus in the embodiment shown in FIG. 3 the arm B' supports the driving member I at its end opposite the point of coupling to the seat. It will appear from FIG. 3 that the supporting arm B' itself is not led through the sliding bearing 2'', which would be feasible without difficulty, but the arm B' cooperates with the bearing 2'' through a slide bar B1 fastened to the supporting arm B' and forming therewith an acute angle, just as the sliding bearing accommodating the arm A' forms an acute angle with the seat frame E', cf. the above. These angles result in a reduction of the forces to be exerted by the driving member through the arms A' and B' on the seat E or on the frame E' of the seat, when the raising movement is initiated.

When the seat mechanism is activated from the lowered position shown in a in FIG. 3, the driving member I will exert a pull tension on the hinge H causing, through the bar G and the fixed hinge point 1', a swinging movement of the bar A' about the hinge point 1' in the clockwise direction shown in FIG. 3. This brings the arm B' to move obliquely upwards and to the right in FIG. 3 over the coupling point D which is moved along a circular arc having its centre in 1', and it is thereby made to move in the stationary sliding bearing 2'' while at the same time pivoting counter-clockwise therein. This results in the driving member I which is supported by the arm B' over the terminal part B'' performing a swinging movement in clockwise direction in relation to the point 2'', i.e. an oblique movement downwards and to the right in FIG. 3 during the first phase of the raising movement, which, however, is not shown in the figure. During the continuing movement of the coupling point D along the said arcuate path, the swinging movement of the driving member continues and in the raised position of the seat E shown in c and e in FIG. 3, the driving member is moved to the right and obliquely upwards, the connecting bar between the driving member I and the hinge point H being partly drawn into the housing of the driving member. The hinge point H is thereby moved along an arcuate path having its centre at point 1'.

During the raising movement, the seat E is activated at its rear edge by the end of the arm A' coupled slidingly thereto in the sliding bearing and at its front edge by the end of the arm B' pivotally coupled thereto, the ratio between the movements of the two arm ends depending on the selected coupling points D, D1, D2, and so far the movement is analogous to that of the embodiment of FIG. 2. In both embodiments, the end of the arm A' coupled to the seat and the coupling point D also follows an arcuate path having its centre in point 1' but, while the end of the arm B' coupled to the seat in FIG. 2 follows a path diverging from a circular arc as a result of the coupling of the opposite end of the arm B' to the fixed point 2' through the connecting bar F, causing a simultaneous rotation of the arm B' about the coupling point D in counter-clockwise direction, so that the resulting movement of the front edge of the seat is imparted a further vertical component, the rotation of the arm B' counter-clockwise about the coupling point D and thereby the introduction of a further vertical component in the movement of the front edge of the seat is achieved in FIG. 3 by guiding the arm B' in a stationary but pivotal sliding bearing 2'' and by coupling the bent terminal part B'' of the arm to the supporting shaft K of the driving member I, said shaft being thereby supported and as a result of the drawing by the driving member of the connecting bar to the hinge point H, being brought closer to said point and to the fixed hinge point 1'.

The arm B' cooperating with the sliding bearing 2'' could also be coupled to a suitable separate driving member to produce the desired activation of the end of the arm B' opposite the point of coupling to the seat frame E', but the embodiment shown, where the arm B' is coupled to the driving member and also activates the arm A', is simple and very reliable and it requires only one driving member to produce all the actuating forces in the mechanism as a whole.

FIGS. 4–6 show a mechanism for one-sided mounting corresponding to the schematic view of FIG. 2, viz. seen from one side in FIG. 4 and in front view in FIG. 5. FIG. 6 shows a sectional view of a detail of FIG. 4. The parts of FIGS. 4–6 which are also shown in FIG. 2 are provided with the same reference signs. It has to be noted that the mechanism of FIG. 4 is, contrary to FIG. 2, shown with the arms A' and B' pivotally interconnected at the point D1, whereby the seat movement is an approximately vertical parallel displacement during the initial phase of movement.

The arms supporting the seat E proper, which in FIG. 4 is a toilet seat, or a supporting frame for the seat, which arms in FIG. 4 extend at right angles to the plane of the drawing, are designated by E1 and E2 and they are mounted reversibly through 180° on a connecting bar E3 coupled to the supporting arms A' and B' of the raising and lowering mechanism, so that said mechanism can be mounted on both sides of a toilet. The connecting bar E3 is through the arms A' and B', see FIG. 2, mounted in the stationary part of the mechanism composed of a fixed chassis L. The chassis L may, for example, be made of tubular profile as indicated and it comprises a horizontal part with rails L1 to be inserted under the toilet, before and behind it, and with bars L2 at right angles thereto, said bars being secured to the rails L1 and extending both on the same side of the toilet. To the horizontal part of the chassis are secured vertical bars L3 which by means of screws or bolts not shown carry bars L4 which can, by means of said screws or bolts, be secured to bars L3 at different heights above the horizontal part L1, L2 of the chassis. The bars L4 serve as fixed suspension point for the supporting arm A' at 1' on the right in FIG. 4 and they further serve to adapt the mechanism to different heights of toilet by vertical displacement in relation to the bars L3. Each of the bars L4 carries a transverse bar L5 in which the other fixed suspension point 2' for the bar F is provided.

At the front edge of the seat E, on the right in FIG. 4 showing the seat partly raised, the connecting bar E3 is pivotally coupled to the arm B' which at its other end is, through the connecting bar F, pivotally coupled to the fixed point 2' in the stationary part of the mechanism, in the example shown the bar L5 fixedly coupled to the chassis L of the mechanism.

Between its coupling points with the connecting bar E3 and the connecting bar F, the arm B' is at D1 pivotally coupled to the other arm A' which at one of its extremities. on the right in FIG. 4, is at 1' pivotally coupled to a fixed point in the stationary chassis L and at its other extremity is slidingly coupled to the connecting bar E3, viz. in the example shown over a ball bearing 4' journalled in a groove 5' provided in a bracket 6' mounted on the connecting bar E3.

At its end pivotally coupled to the chassis at 1', the arm A' is fixedly coupled to, e.g. manufactured in one piece or welded together with, a driving arm M coupled at its opposite end to a spindle N1 projecting from a driving member N, which spindle can be actuated by the driving member to move backwards and forwards in its longitudinal direction, e.g. by designing the spindle N1 as an externally threaded spindle in engagement with a nut pivotable in the driving member N.

In the slightly raised position of the seat E shown in FIG. 4, the spindle N1 is a little drawn into the driving member N and consequently the arm A' through the driving arm M has been pivoted a litle in clockwise direction about the fixed point 1'.

The movement of the arm A' has through the coupling point D1 been transferred to the arm B' which as a result of its connection through the bar F with the fixed point 2' has been pivoted counter-clockwise about the point of coupling D1 with the arm A'. The bar F effects a pivotal movement counter-clockwise about the point 2', and the movement of the connecting point F1 between the arm B' and the bar F, said bar F being in the starting position with lowered seat approximately in a vertical position, cf. also FIG. 2, has during this first phase of the raising movement a maximum horizontal component which has an intensifying effect on the rotation of the arm B' counter-clockwise about the point D1. The resulting movement of the seat is, as appears from FIG. 4, at this stage of the raising essentially a vertical parallel displacement of the seat, whereas part of the horizontal component of the movement made by the end of the arm A' coupled to the rear edge of the seat at E1 and following a circular arc having its centre at point 1' is absorbed in the bearing 4', 5'.

While the arm A' is activated to continue its clockwise rotation about the point 1', the pivotal movement of the bar F counter-clockwise about the point 2' continues also and as the bar F withdraws from the vertical position, the horizontal component of its movement which will come close to zero when the bar F is near the horizontal position, decreases while at the same time the vertical component increases correspondingly. By so doing, however, the amplifying influence of the bar F on the counter-clockwise rotation of the arm B' about the point D1 will be changed into a weakening influence. The result is that the upward movement of the rear edge of the seat at E1 will become predominant so that the seat, dependent on the choice of coupling point D, D1, will take a more and more oblique position onward. From FIG. 2 showing a raising movement with a great inclination of the seat by use of the coupling point D instead of D1, it appears, cf. the positions of the bar F and of the arms A' and B' shown, that the front edge of the seat at E2 during the phase of the raising movement shown moves downward and that the resulting movement of the seat as a whole here is an onward and obliquely downward movement.

FIG. 5 shows the raising and lowering mechanism seen from the right of FIG. 4 and placed on one side of a toilet which is outlined.

The driving member which is not shown in FIG. 5 activates the mechanism through the joint M1 where the spindle N1 is coupled to the bar M, composed here of two interconnected parallel bars and fixedly connected at its other end, e.g. welded together with the supporting arm A' which in the embodiment shown is made as a rectangular tubular profile. At the junction between the bar M and the arm A', the latter is mounted on a shaft journalled in the stationary chassis, said shaft being indicated in FIG. 5 by a dotted line 1' corresponding to the above-mentioned fixed hinge point 1' for the arm A'. The shaft connecting pivotally the arm A' with the arm B' which, like the bar M, is in the embodiment shown composed of two interconnected parallel bars, is also indicated by dotted lines designated as D1 like the corresponding coupling point between the arms A' and B' in FIG. 4. The shaft constituting the connecting point F1 between the bar combination B' and the connecting bar F is also correspondingly designated F1. The shaft corresponding to the fixed point 2' which accommodates pivotally one end of the bar F and is journalled in the bar L5 in the stationary chassis L is correspondingly designated 2' in FIG. 5.

At its end opposite the connecting point F1 with the bar F, the supporting arm B' is coupled to the front edge of the seat E, i.e. the connecting bar E3 and the arm E2 supporting the seat, through a shaft 7. The shaft 7 which extends through two parallel bars constituting the arm B' accommodates pivotally between these bars, both designated B', one end of the bar E3 serving as connecting joint and of tubular shape in the embodiment shown. On its top side the bar E3 carries, for instance is welded together with, a U-shaped part 8 whose open side turns upward and in which the foremost supporting arm E2 of the seat is journalled in the above-mentioned manner, i.e. 180° reversible, e.g. by means of bolts 8' as indicated. The rearmost supporting arm E1 at the rear edge of the seat is correspondingly journalled reversibly in a U-shaped part secured to the connecting bar E3 and designated by 8 as at E2.

The connection between the other supporting arm A' and the rear edge of the seat E through the connecting bar E3 and the seat supporting arm E1, which connection is constituted by the bracket 6' and the ball bearing 4' in FIG. 4, is not shown in FIG. 5 but FIG. 6 shows a sectional view of the bracket along line VI—VI in FIG. 4.

The seat supporting arm E1 is, as already mentioned, coupled to the connecting bar E3 over a U-shaped part 8 in the manner explained above with reference to the connection between the arm E2 and the bar E3. The load originating from the user of the seat is applied to the right of the connection between the arm A' and the bar E3 shown in FIG. 6, as indicated by the arrow P, and it has the character of a clockwise torque.

In order to take up this load, the arm A' is provided with a through-going shaft 9 carrying on both sides of the arm A' a rotary wheel 4 and 4' which may, for instance, be constituted of ball bearings mounted on the shaft ends. The wheel 4 abuts at its periphery against a flange 5 on a bracket 6 mounted in the connecting bar E3 above the wheel 4. Correspondingly, the wheel 4' at the opposite side of the arm A' abuts against a flange 5' on a bracket 6' also secured to the bar E3 but having the flange 5' located below the wheel 4'. The torsional strain originating from the loaded connecting bar E3 is thereby absorbed while, at the same time, the displaceability of the arm A' in the longitudinal direction of the bar E3 is secured.

FIG. 7 shows a practical embodiment of a raising and lowering mechanism particularly suitable for being mounted in an ordinary chair, e.g. an armchair, and corresponding to the outline of FIG. 3.

The supporting frame 10 is provided with two hinge fittings, of which only one can be seen in the sectional view of FIG. 7 and where it is designated 1', since it constitutes the fixed point 1' of FIG. 3. The fitting 1' is pivotally coupled to the supporting arm A' which at its other end is slidingly coupled to the supporting frame E' of the seat through a block 11 connected with the arm A', said block having a track which is in engagement with a flange on an angle piece or L-piece secured to the seat frame E'. The flange on the angle piece 12 cooperating with the track in the block 11 forms an angle with the plane of the seat frame, as described above with reference to FIG. 3.

Between its extremities, the arm A' is coupled to the other supporting arm B' at the connecting point D2, as shown, or at alternative connecting points D1, D.

The supporting arm B' is at one end pivotally coupled to the seat frame E' at its edge opposite the connection of said frame with the arm A', and at its other end the arm B' carries, through the connecting bar B'', the driving member I pivotally suspended on a shaft K. The spindle of the driving member is at the point H pivotally coupled to a bar G connected with the supporting arm A'. The fixed point with which the arm B' cooperates is at pivot bearing 2'', in the embodiment shown a block 13 is pivotally secured to the frame 10 at pivot bearing 2'' and is provided with a track wherein is guided a flange projecting at right angles from the arm B', for instance the flange of an angle piece in the form of a slide bar B1 (see FIG. 3) secured to the arm B'. As will be seen in FIG. 7, the flange forms an acute angle with the arm B'.

When the driving member I from the position shown in FIG. 7 where the seat is partly raised, continues its operation, the hinge points K and H will be drawn toward each other and the arm A' will, like the bar G, rotate clockwise about the fixed point 1'. The coupling point D2 between the arms A' and B' is moved like the coupling point H along a circular arc having its centre at 1', but at the same time the arm B' is activated from the coupling point K with the driving member I through the bar B'' as described in the foregoing with reference to FIG. 3.

The driving member I is rotated by the movement of the arm G, through the point H, to rotate counter-clockwise about the suspension point K, while at the same time it is subjected through the point H and the driving spindle connected therewith to a pull toward the point H. Thereby the driving member activates also the arm B', through the point K and the bar B'', to slide longitudinally in the track of block 13 carried on pivot bearing 2'' and to rotate counter-clockwise in said bearing, and the combined rotational and sliding force conveyed by the arm A′ to the arm B′ through the point D2 is consequently supported via the bearing 2″ from the driving member. This results in a better distribution of the load than the one which would be achieved if the driving member I was suspended in the fixed frame 10 and the connecting bar B″ was removed, in which case the part of the arm A′ situated between the hinge points 1′ and D2 should take up the full load.

Also in this case, the movement is first a mainly vertical parallel displacement of the seat which thereafter is moved obliquely onward, the front edge of the seat being lowered while the rear edge is raised, cf. FIG. 3.

I claim:

1. A mechanism having a driving member for raising and lowering a seat on a sitting-accommodation, such as a chair for handicapped persons, such mechanism comprising:

two supporting arms, a first supporting arm having a first end thereof coupled to the seat at the rear edge thereof and having a second end, and a second supporting arm having a first end thereof coupled to the seat at the front edge thereof and having a second end;

means for pivotally interconnecting said two supporting arms to each other intermediate of their ends, said first supporting arm at its second end being pivotally coupled to a fixed hinge point carried by said sitting accommodation;

a driving member directly connected to said fixed supporting arm at a first pivot point spaced from said fixed hinge point and movable relative thereto for pivotally moving said first arm about said fixed hinge point, and said driving member directly connected to said second supporting arm at a second end of said second arm, via a second pivot point, said second pivot point spaced from said first pivot point and movable relative to said fixed hinge point and said first pivot point upon actuation of said driving member;

a block pivotally carried on said sitting accommodation by a pivot bearing, said second supporting arm being slidably coupled to said block for rotation about said pivot bearing and for longitudinal sliding displacement in relation to said block.

2. A mechanism as claimed in claim 1, wherein the other of said two supporting arms is guided in a longitudinally sliding manner in the stationary pivotal member by a rail fastened to the other arm and forming an acute angle of from about 10° to about 15° therewith.

3. A mechanism according to claim 2, wherein said first arm is said one of said two supporting arms and is slidingly coupled at its first end to the seat, said seat carrying a guide which forms an acute angle of from about 10° to about 15° with the plane of the seat for slidingly coupling said first arm with said seat.

4. A mechanism according to claim 1, wherein said first arm is said one of said two supporting arms and is slidingly coupled at its first end to the seat, said seat carrying a guide which forms an acute angle of from about 10° to about 15° with the plane of the seat for slidingly coupling said first arm with said seat.

5. A mechanism according to claim 5, wherein said two supporting arms are in axial alignment with each other when said seat is in a lowermost position.

6. A mechanism according to claim 1, wherein said mechanism includes a guide at the rear edge of said seat, said guide positioned at an acute angle and extending downwardly relative to the plane of the seat, and said first end of said first supporting arm is slidingly carried on said guide.

* * * * *